US012768052B2

(12) United States Patent
Nasu et al.

(10) Patent No.: US 12,768,052 B2
(45) Date of Patent: Oct. 20, 2026

(54) COATED CUTTING TOOL

(71) Applicant: MOLDINO TOOL ENGINEERING, LTD., Tokyo (JP)

(72) Inventors: Norihito Nasu, Narita (JP); Tomoya Sasaki, Yasu (JP)

(73) Assignee: MOLDINO Tool Engineering, Ltd., Tokyo (JP)

( * ) Notice: Subject to any disclaimer, the term of this patent is extended or adjusted under 35 U.S.C. 154(b) by 664 days.

(21) Appl. No.: 18/033,408

(22) PCT Filed: Mar. 22, 2022

(86) PCT No.: PCT/JP2022/012943
§ 371 (c)(1),
(2) Date: Apr. 24, 2023

(87) PCT Pub. No.: WO2022/202729
PCT Pub. Date: Sep. 29, 2022

(65) Prior Publication Data

US 2023/0390829 A1 Dec. 7, 2023

(30) Foreign Application Priority Data

Mar. 24, 2021 (JP) ..... 2021-049708

(51) Int. Cl.
*C23C 28/04* (2006.01)

(52) U.S. Cl.
CPC ..... *C23C 28/042* (2013.01); *C23C 28/044* (2013.01)

(58) Field of Classification Search
None
See application file for complete search history.

(56) References Cited

U.S. PATENT DOCUMENTS

2011/0086233 A1 4/2011 Yamamoto et al.
2012/0009403 A1 1/2012 Koike et al.
2017/0096733 A1 4/2017 Sasaki et al.
(Continued)

FOREIGN PATENT DOCUMENTS

CN 111511490 A 8/2020
CN 111575660 A 8/2020
(Continued)

OTHER PUBLICATIONS

International Search Report mailed Jun. 7, 2022, issued for PCT/JP2022/012943 and English translation thereof.
(Continued)

*Primary Examiner* — Kim S. Horger
(74) *Attorney, Agent, or Firm* — Troutman Pepper Locke LLP; James E. Armstrong, IV

(57) ABSTRACT

A coated cutting tool includes a substrate and a hard coating film. The hard coating film includes a b layer which is disposed on the substrate, a c layer which is a multilayer coating film laminated on the b layer and in which a c1 layer of a nitride or a carbonitride containing Al and Cr and a c2 layer of a nitride or a carbonitride containing Ti and Si are alternately laminated with a film thickness of 50 nm or less, respectively, and a d layer which is disposed on the c layer and is a nitride or a carbonitride of TiSi. The c layer contains 0.10 atomic % or less of Ar with respect to a total amount of a metal (including metalloid) element and a non-metal element.

5 Claims, 3 Drawing Sheets

(56) References Cited

U.S. PATENT DOCUMENTS

| | | | |
|---|---|---|---|
| 2019/0247930 | A1 | 8/2019 | Tanaka et al. |
| 2020/0298316 | A1 | 9/2020 | Sasaki et al. |
| 2021/0086268 | A1 | 3/2021 | Tanaka et al. |

FOREIGN PATENT DOCUMENTS

| | | | | |
|---|---|---|---|---|
| JP | 2006-152321 | A | | 6/2006 |
| JP | 2011-093085 | A | | 5/2011 |
| JP | 2011235393 | A | * | 11/2011 |
| JP | 2019-528183 | A | | 10/2019 |
| JP | 6743349 | B2 | | 8/2020 |
| KR | 10-2011-0018417 | A | | 2/2011 |
| KR | 10-2011-0102948 | A | | 9/2011 |
| KR | 10-2016-0131046 | A | | 11/2016 |
| WO | 2017/170536 | A1 | | 10/2017 |
| WO | 2018/025977 | A1 | | 2/2018 |
| WO | 2018/100849 | A1 | | 6/2018 |

OTHER PUBLICATIONS

Supplementary European Search Report dated Jan. 7, 2025, issued for EP22773409.2.
Notice of Allowance mailed Apr. 15, 2025, issued for KR10-2023-7017777 and English translation thereof.
Office Action mailed Jun. 24, 2025, issued for CN202280007688.9 and English translation of the Search Report.

* cited by examiner

COATED CUTTING TOOL

TECHNICAL FIELD

The present invention relates to a coated cutting tool.

Priority is claimed on Japanese Patent Application No. 2021-049708, filed Mar. 24, 2021, the content of which is incorporated herein by reference.

BACKGROUND ART

In the related art, as a technology for increasing the life of a cutting tool, a surface treatment technology for coating a surface of a cutting tool with a hard coating film formed of various ceramics has been adopted. In recent years, for example, a coated cutting tool provided with multilayer coating films alternately laminated with nano-level film thicknesses, as disclosed in Patent Document 1, has been widely used.

PRIOR ART DOCUMENT

Patent Document

[Patent Document 1]

Japanese Unexamined Patent Application, First Publication No. 2006-152321

SUMMARY OF THE INVENTION

Problems to be Solved by the Invention

According to the studies of the present inventors, it was confirmed that there is room for improvement in durability of a coated cutting tool having a multilayer film structure that has been proposed in the related art.

Means for Solving the Problem

One aspect of the present invention is a coated cutting tool including a substrate, and a hard coating film formed on the substrate, in which the hard coating film includes a b layer which is disposed on the substrate and is formed of a nitride or a carbonitride, a c layer which is a multilayer coating film disposed on the b layer and in which a c1 layer of a nitride or a carbonitride containing Al and Cr and a c2 layer of a nitride or a carbonitride containing Ti and Si are alternately laminated with a film thickness of 50 nm or less, respectively, and a d layer which is disposed on the c layer and is a nitride or a carbonitride of TiSi, and the c layer contains 0.10 atomic % or less of Ar with respect to a total amount of a metal (including metalloid) element and a non-metal element, in a case where a total of the metal (including metalloid) element, nitrogen, oxygen, carbon, and the Ar is set as 100 atomic %, an atomic ratio A of the nitrogen and an atomic ratio B of the metal (including metalloid) element in the c layer satisfies a relationship of $1.02<A/B$, and the c layer has a face-centered cubic lattice structure.

Effects of the Invention

According to the present invention, it is possible to provide a coated cutting tool having excellent durability.

EMBODIMENTS OF THE INVENTION

Figure 1:
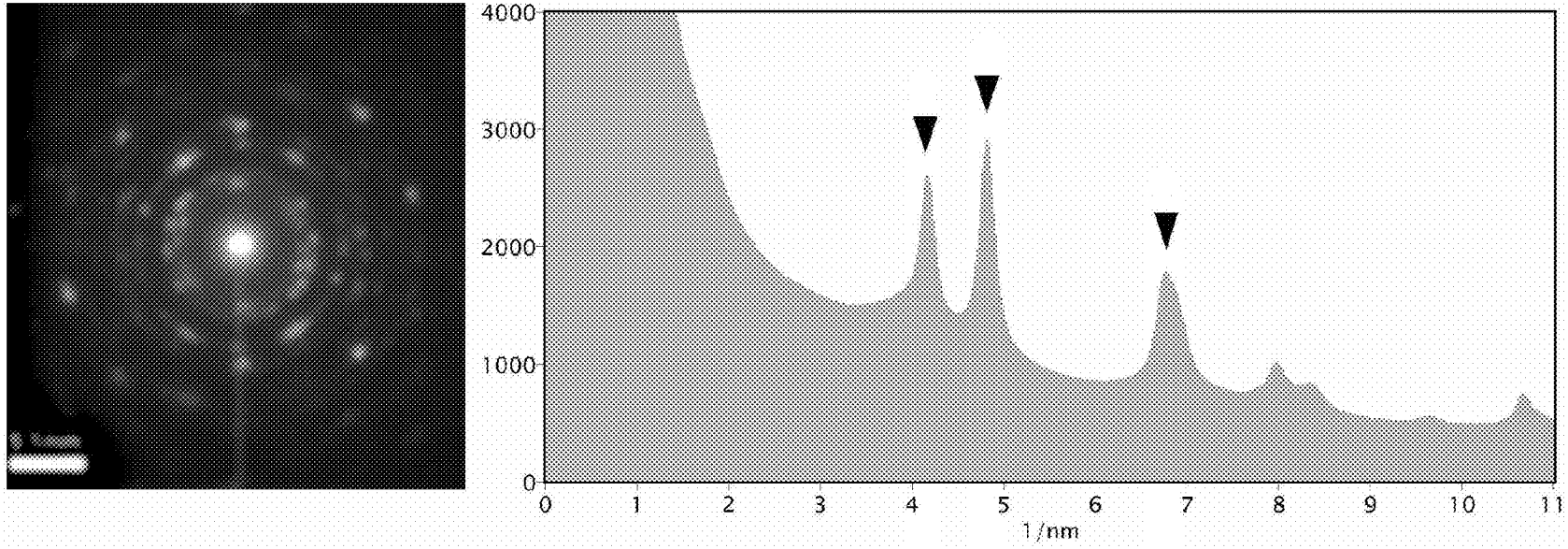
FIG. 1 is an example showing a selected area diffraction pattern of a sample No. 1 and an intensity profile thereof.

A coated cutting tool of the present embodiment includes a substrate, and a hard coating film formed on the substrate. The hard coating film includes a b layer formed of a nitride or a carbonitride, a c layer formed of a multilayer coating film, and a d layer formed of a nitride or a carbonitride of TiSi in the order from a side of the substrate. Hereinafter, each layer will be described in detail.

In the coated cutting tool of the present embodiment, the substrate is not particularly limited, and a WC—Co-based cemented carbide having excellent strength and toughness is preferably used as the substrate.

The b layer according to the present embodiment is a nitride or a carbonitride disposed on the substrate. The b layer is a base layer which increases adhesiveness between the substrate and the c layer which is a multilayer coating film. Since the b layer disposed on the substrate is formed of a nitride or a carbonitride, a coated cutting tool having excellent adhesiveness between the substrate and the hard coating film is obtained. The b layer is preferably formed of a nitride having excellent heat resistance and wear resistance. In addition, in order to increase adhesiveness with the c layer, which is the multilayer coating film, the b layer is preferably a nitride or a carbonitride of one element or two or more elements selected from Al, Cr, and Ti. The b layer preferably contains 50 atomic % or more and 70 atomic % or less of Al with respect to a total amount of the metal (including metalloid, the same applies hereinafter) element. A crystal structure of the b layer is preferably a face-centered cubic lattice structure. Accordingly, in the c layer which is a multilayer coating film provided on the b layer, AlN with a hcp structure contained in a microstructure of the c layer is reduced. The reduction of the brittle AlN phase with hcp structure may improve durability of the coated cutting tool. In a case where the b layer is formed of a nitride or a carbonitride, the b layer may be configured with a plurality of layers having different compositions.

The b layer is preferably a coating film thicker than the entire c layer. A film thickness of the b layer is preferably two or more times to ten or less times a film thickness of the c layer. The film thickness of the b layer is preferably in a range of 0.2 μm or more and 4.0 μm or less.

The c layer according to the present embodiment is a multilayer coating film provided between the b layer which is the base layer, and the d layer which is a nitride or a carbonitride of TiSi which will be described later.

Specifically, the c layer is a multilayer coating film in which a c1 layer of a nitride or a carbonitride containing Al and Cr and a c2 layer of a nitride or a carbonitride containing Ti and Si are alternately laminated with a film thickness of 50 nm or less, respectively. An AlCr-based nitride or carbonitride is a film type having excellent heat resistance. A TiSi-based nitride or carbonitride is a film type having excellent wear resistance. By laminating these alternately at the nano level, the adhesiveness of the entire hard coating film is improved and the heat resistance and the wear resistance become excellent. The c layer is preferably a nitride having excellent heat resistance.

A film thickness of the entire layer c is preferably in a range of 0.05 μm or more and 2.0 μm or less.

The c1 layer is formed of a nitride or a carbonitride containing Al and Cr. The c1 layer preferably contains 50 atomic % or more of Al with respect to a total amount of the metal element. The c1 layer preferably has a total content ratio of Al and Cr of 80 atomic % or more with respect to the total amount of metal element. The c1 layer may contain Ti and Si contained in the c2 layer.

The c2 layer is formed of a nitride or a carbonitride containing Ti and Si. The c2 layer preferably contains 50 atomic % or more of Ti with respect to the total amount of metal element. The c2 layer preferably contains 10 atomic % or more of Si with respect to the total amount of metal element. The c2 layer can contain Al and Cr contained in the c1 layer.

In an average composition of the c layer, a total of Al, Ti, and Cr is preferably atomic % or more with respect to the total amount of metal element. In the average composition of the c layer, a content ratio of Al is preferably the largest with respect to the total amount of metal element. In the average composition of the c layer, a content ratio of Al is preferably 30 atomic % or more and 50 atomic % or less with respect to the total amount of metal element. In the average composition of the c layer, a content ratio of Ti or Cr is preferably the second largest after that of Al. In the average composition of the c layer, a total of Ti and Cr is preferably 50 atomic % or more and 80 atomic % or less with respect to the total amount of metal element.

In the average composition of the c layer, the content ratio of Ti is preferably 15 atomic % or more and 40 atomic % or less with respect to the total amount of metal element. In the average composition of the c layer, the content ratio of Cr is preferably atomic % or more and 40 atomic % or less with respect to the total amount of metal element. In the average composition of the c layer, a content ratio of Si is preferably 3 atomic % or more and 20 atomic % or less with respect to the total amount of metal element. In the average composition of the c layer, a content ratio of Si is preferably 5 atomic % or more with respect to the total amount of metal element. In the average composition of the c layer, a content ratio of Si is preferably 15 atomic % or less with respect to the total amount of metal element.

The c layer can contain metal elements other than Al, Ti, Cr, and Si. For example, for the purpose of improving the wear resistance and the heat resistance, one element or two or more elements selected from elements of Groups 4a, 5a, and 6a of the periodic table, B, Y, Yb, and Cu can also be contained. These elements are generally contained in order to improve a coating property of the coated cutting tool, and can be added within a range that does not significantly deteriorate the durability of the coated cutting tool. However, in a case where the content ratio of the metal elements other than Al, Ti, Cr, and Si is excessively high, the durability of the c layer may be deteriorated. Therefore, in a case where the c layer contains the metal elements other than Al, Ti, Cr, and Si, a total content ratio thereof is preferably 15 atomic % or less. Also, it is preferably 10 atomic % or less.

In a case where a total of the metal (including metalloid) element, nitrogen, oxygen, carbon, and Ar is set as 100 atomic %, the c layer has an atomic ratio A of nitrogen and an atomic ratio B of the metal (including metalloid) element in the hard coating film satisfying a relationship of $1.02<A/B$. Accordingly, the multilayer coating film becomes N-rich, a nitride is formed at a micro level, and AlN having the hcp structure is reduced. In addition, the crystallinity of the c layer is increased, crystal structures at interfaces between the c layer and the b layer, and between the c layer and the d layer are matched, and the adhesiveness of the hard coating film as a whole is improved. The c layer preferably satisfies a relationship of $1.05<A/B$. However, in a case where the amount of N is excessively high, a residual compressive stress of the hard coating film excessively increases, and the hard coating film tends to self-destruct. Therefore, the c layer preferably satisfies a relationship of $A/B<1.20$. In addition, the c layer preferably satisfies a relationship of $A/B<1.12$. Furthermore, the c layer preferably satisfies a relationship of $A/B<1.10$.

The c layer contains 0.1 atomic % or less of argon (Ar) with respect to the total amount of the metal (including metalloid) element and the non-metal element (the entire hard coating film).

In a sputtering method, the hard coating film is coated by sputtering a target component using argon ions. Therefore, the hard coating film is likely to contain argon.

As a crystal grain size of the hard coating film becomes finer, a hardness increases, however, the number of grain boundaries increases, and the argon contained in the hard coating film concentrates at the grain boundaries. In a case where a content ratio of the argon in the hard coating film is excessively high, a toughness of the hard coating film is reduced, which makes it difficult to exhibit sufficient tool performance. Therefore, in the present embodiment, the c layer contains 0.1 atomic % or less of argon to reduce the amount of argon that concentrates at the grain boundaries of the hard coating film. In the present embodiment, a lower limit of the content ratio of argon (Ar) is not particularly limited. Since the hard coating film according to the present embodiment is coated by the sputtering method, the hard coating film can contain 0.02 atomic % or more of argon (Ar). The content ratio of argon in the c layer is preferably 0.08 atomic % or less, and more preferably 0.05 atomic % or less. By setting the content ratio of argon in the range described above, a mechanical property of the c layer can be further improved.

The hard coating film according to the present embodiment may contain small amounts of argon, oxygen, and carbon as the non-metal elements, in addition to nitrogen. The content ratio of argon can be obtained by setting a content ratio of the metal (including the metalloid) element, nitrogen, oxygen, carbon, and argon as 100 atomic %.

The c layer has a face-centered cubic lattice structure (an fcc structure). In the present embodiment, the face-centered cubic lattice structure means that a diffraction peak intensity due to the face-centered cubic lattice structure is a maximum intensity in a selected area diffraction pattern or the like using an X-ray diffraction or transmission electron microscope (TEM). Accordingly, in a case where the diffraction peak intensity due to the face-centered cubic lattice structure as a whole of the hard coating film exhibits the maximum intensity, the hard coating film has the face-centered cubic lattice structure, although a partially hexagonal close-packed structure (the hcp structure) or an amorphous phase is included in micro analysis using a transmission electron microscope (TEM). On the other hand, since the hard coating film having a maximum diffraction peak intensity due to the hcp structure is brittle, the durability tends to be deteriorated, in a case where the hard coating film is applied to the coated cutting tool. The crystal structure of the hard coating film according to the present embodiment can be confirmed by, for example, X-ray diffraction or a selected area diffraction pattern using the transmission electron microscope (TEM). In a case where a test area of the hard coating film is small, it may be difficult to identify the crystal structure due to the X-ray diffraction. Even in such a case, the crystal structure can be identified by the selected area diffraction pattern or the like using the transmission electron microscope (TEM). The hard coating film of the present invention preferably does not have a diffraction pattern of MN having the hcp structure in the selected area diffraction pattern.

The d layer is a nitride or a carbonitride of TiSi, which is a film type having excellent wear resistance. In a case where the d layer is a nitride or a carbonitride of TiSi, a nanoindentation hardness tends to be higher than 40 GPa. In addition, the nanoindentation hardness of the d layer is preferably 42 GPa or more. In addition, with the nitride and carbonitride of TiSi, the structure of the hard coating film is fine, the hard coating film has a high hardness and excellent heat resistance, and a high residual compressive stress is also applied. Therefore, by providing the d layer formed of the nitride or carbonitride of TiSi on an upper layer of the multilayer coating film, it is possible to significantly improve the durability of the coated cutting tool under a usage environment with a high load. In order to exhibit a property of the nitride or carbonitride of TiSi, a content ratio of Ti in the d layer is preferably 60 atomic % or more and 95 atomic % or less. In addition, a content ratio of Si in the d layer is preferably 5 atomic % or more and 40 atomic % or less. The d layer is preferably formed of a nitride having excellent heat resistance and wear resistance. A crystal structure of the d layer is preferably a face-centered cubic lattice structure. The d layer preferably does not contain an amorphous phase. In addition, as necessary, another layer may be provided on the upper layer of the d layer.

The d layer is preferably a coating film thicker than the entire c layer. A film thickness of the d layer is preferably two or more times to ten or less times a film thickness of the c layer. The film thickness of the d layer is preferably in a range of 0.2 μm or more and 4.0 μm or less.

In the coating of the hard coating film according to the present embodiment, it is preferable to apply the sputtering method of sputtering a target component to coat the hard coating film, among physical vapor deposition methods.

In the physical vapor deposition methods, the residual compressive stress is imparted to the hard coating film, and chipping resistance tends to be excellent. Among the physical vapor deposition methods, an arc ion plating method is widely used because it tends to have a high ionization rate of the target component and excellent adhesiveness of the hard coating film. However, in the arc ion plating method, since the target component is melted by arc discharge, inevitable impurities such as oxygen and carbon contained in a furnace are easily incorporated into the hard coating film, and thus, it tends to be difficult to obtain a hard coating film having high content ratio of nitrogen.

Therefore, by applying the sputtering method that does not melt the target, the amount of inevitable impurities such as oxygen or carbon contained in the hard coating film tends to be reduced. However, in a DC sputtering method of the related art or a high-output sputtering method for simply applying high power to the target, since the ionization rate of the target is low, the nitride formed on the hard coating film is not sufficient. Therefore, among the sputtering methods, it is preferable to apply a sputtering method of applying power sequentially to the targets, and at switching the targets to which the power is to be supplied, to provide time for which the power is applied at the same time to both targets of a target for ending the application of power and a target for starting the application of power.

By coating by such a sputtering method, a state of a high ionization rate of the target is maintained during film formation, the crystallinity of the hard coating film is high, and a sufficient amount of nitride tends to be formed.

In addition, in order to form a sufficient amount of nitride in the hard coating film, a maximum power density of a power pulse is preferably 0.5 $kW/cm^2$ or more. However, in a case where the power density applied to the target is excessively high, the film formation is difficult to be stabilized. In addition, in a case where the time for which the power is applied at the same time to both alloy targets of an alloy target for ending the application of power and an alloy target for starting the application of power is excessively short or long, the ionization of the target is not sufficient, and it is difficult to form a sufficient amount of nitride on the hard coating film. Therefore, it is preferable that the time for which the power is applied at the same time to both the alloy targets of the alloy target for ending the application of power and the alloy target for starting the application of power is 5 microseconds or more and 20 microseconds or less. In order to increase the ionization rate of the target components, it is preferable to use 3 or more AlCr-based alloy targets and 3 or more TiSi-based alloy targets.

In addition, it is preferable that preliminary discharge is performed at a temperature in a furnace of a sputtering apparatus of 430° C. or higher, a flow rate of a nitrogen gas introduced into the furnace is 410 sccm or more, and a flow rate of an argon gas is 300 sccm or more and 450 sccm or less. Further, a pressure in the furnace is preferably 0.6 Pa to 0.8 Pa. In order to improve the content of nitrogen, the coating is performed under the conditions described above, thereby reducing the content ratio of argon and oxygen in the hard coating film and easily increasing the content ratio of nitrogen. In addition, in order to make the hard coating film have the face-centered cubic lattice structure and a fine-grained structure with high crystallinity, a negative bias voltage applied to a cutting tool as a substrate is preferably controlled within a range of −V to −40 V.

Hereinafter, the present invention will be described in more detail with reference to examples and comparative examples, but the present invention is not limited to the following examples.

EXAMPLE 1

In Example 1, first, physical properties of a multilayer coating film were evaluated under different film forming conditions.

<Tool>

As a tool, a two-blade ball end mill of cemented carbide (a tool diameter of 0.8 mm, manufactured by MOLDING Tool Engineering, Ltd.) having a composition of WC (bal.)-Co (8.0 mass %)-Cr (0.5 mass %)-Ta (0.3 mass %), a WC average grain size of 0.5 μm, and a hardness of 93.6 BRA (Rockwell hardness, a value measured based on JIS G 0202) was prepared.

A sputtering apparatus capable of mounting 12 sputtering vaporization sources was used. Among these vaporization sources, 6 AlCr-based alloy targets (Al58% Cr40% Si2%, the numbers are atomic ratios, the same applies hereinafter) and 6 TiSi-based alloy targets (Ti80% Si20%) were installed in the apparatus as the vaporization sources. A target having a diameter of 16 cm and a thickness of 12 mm was used.

The tool was fixed to a sample holder in the sputtering apparatus and a bias power supply was connected to the tool. The bias power supply has a structure that applies a negative bias voltage to the tool independently of the target. The tool rotates at 3 revolutions per minute and revolves through a fixing jig and a sample holder. A distance between the tool and a target surface was set as 100 mm.

Ar and $N_2$ were used as an introduction gas, and were introduced from a gas supply port provided in the sputtering apparatus.

<Bombardment Treatment>

For a sample No. 1, first, a bombardment treatment was performed on a tool in the following procedure before the tool is coated with a hard coating film. Heating was performed for 30 minutes in a state where a temperature in a furnace was 430° C. by a heater in the sputtering apparatus. After that, the inside of the furnace of the sputtering apparatus was evacuated, and a pressure in the furnace was set as $5.0\times10^{-3}$ Pa or less. In addition, Ar gas was introduced into the furnace of the sputtering apparatus, and the pressure in the furnace was adjusted to 0.8 Pa. Also, a DC bias voltage of −200 V was applied to the tool, and cleaning (the bombardment treatment) of the tool by Ar ions was performed.

Next, while maintaining the temperature in the furnace at 430° C., Ar gas was introduced into the furnace of the sputtering apparatus in an amount of 400 sccm, and then $N_2$ gas was introduced in an amount of 470 sccm to set the pressure in the furnace as 0.70 Pa. A −50 V DC bias voltage was applied to the tool, a maximum power density of 0.6 kW/cm$^2$ was applied to the AlCr-based alloy target, the discharge time per power cycle was set as 0.8 milliseconds, and time, for which the powers are applied to the AlCr-based alloy targets at the same time, was set as 10 microseconds. In addition, a maximum power density of 1.5 kW/cm 2 was applied to the TiSi-based alloy target, the discharge time per cycle of power was 3.6 milliseconds, and the time, for which during which the power was applied to the TiSi-based alloy target at the same time, was set as microseconds. Then, by continuously applying power to each alloy target, a multilayer coating film having an individual film thickness of approximately 4 nm and a total film thickness of approximately 2 μm was coated.

A sample No. 2 was set to be the same as the sample No. 1, except that the introduction flow rate of the $N_2$ gas was set as 420 sccm and the pressure in the furnace was set as 0.62 Pa when coating the multilayer coating film.

A sample No. 3 was set to be the same as the sample No. 1, except that the introduction flow rate of the $N_2$ gas was set as 520 sccm and the pressure in the furnace was set as 0.78 Pa when coating the multilayer coating film.

A sample No. 4 was set to be the same as the sample No. 1, except that the introduction flow rate of the $N_2$ gas was set as 560 sccm and the pressure in the furnace was set as 0.83 Pa when coating the multilayer coating film.

A sample No. 5 was set to be the same as the sample No. 1, except that the introduction flow rate of the $N_2$ gas was set as 600 sccm and the pressure in the furnace was set as 0.88 Pa when coating the multilayer coating film.

A sample No. 6 was set to be the same as the sample No. 1, except that the introduction flow rate of the $N_2$ gas was set as 340 sccm and the pressure in the furnace was set as 0.57 Pa when coating the multilayer coating film.

A sample No. 7 was set to be the same as the sample No. 1, except that the introduction flow rate of the $N_2$ gas was set as 400 sccm and the pressure in the furnace was set as 0.60 Pa when coating the multilayer coating film.

A hardness and an elastic modulus were measured using a nanoindentation tester (ENT-2100 manufactured by Elionix Co., Ltd.).

A coating film composition of the hard coating film was measured by a wavelength-dispersive electron probe microanalyzer (WDS-EPMA) attached to an electron probe microanalyzer (JXA-8500F manufactured by JEOL Ltd.). In measurement conditions, an acceleration voltage was set as 10 kV, an irradiation current was set as $5\times10^{-8}$ A, and a take-in time was set as 10 seconds, the measurement was performed on five points of an analysis region in a range of a diameter of 1 μm, and a content ratio of metal and a content ratio of Ar of a total of the metal component and the non-metal component of the hard coating film were obtained from an average value thereof.

TABLE 1

| | Multilayer coating film | | | | |
|---|---|---|---|---|---|
| | Average composition (atomic %) | A/B | Ar (atomic %) | Hardness (GPa) | Elasticity (GPa) |
| Sample No. 1 | (Ti24Al41Cr28Si7)N | 1.08 | 0.0587 | 35 | 490 |
| Sample No. 2 | (Ti24Al39Cr30Si7)N | 1.04 | 0.0908 | 32 | 480 |
| Sample No. 3 | (Ti28Al37Cr27Si8)N | 1.09 | 0.0408 | 33 | 525 |
| Sample No. 4 | (Ti30Al36Cr26Si8)N | 1.09 | 0.0468 | 34 | 550 |
| Sample No. 5 | (Ti31Al35Cr25Si9)N | 1.11 | 0.0459 | 33 | 550 |
| Sample No. 6 | (Ti21Al42Cr31Si6)N | 0.96 | 0.1849 | 28 | 390 |
| Sample No. 7 | (Ti24Al39Cr30Si7)N | 1.03 | 0.1205 | 32 | 500 |

It was confirmed that the samples No. 1 to 5 had a high content ratio of nitrogen and high hardness and elastic modulus. On the other hand, it was confirmed that the sample No. 6 had a low content ratio of nitrogen and low hardness and elastic modulus. In addition, it us confirmed that the samples No. 1 to 5 also had a low content ratio of Ar, compared to the samples No. 6 and 7.

TEM analysis was performed to confirm a difference between the samples No. 1, 2, and 6 at the micro level. A selected area diffraction pattern of the multilayer coating film was obtained by TEM under the conditions of an acceleration voltage of 120 kV, a selected area of φ750 nm, a camera length of 100 cm, and an incident electron amount of 5.0 pA/cm 2 (on a fluorescent screen). A brightness of the obtained selected area diffraction pattern was converted to obtain an intensity profile. An analysis point was set as an intermediate portion in a film thickness direction.

Figure 2:
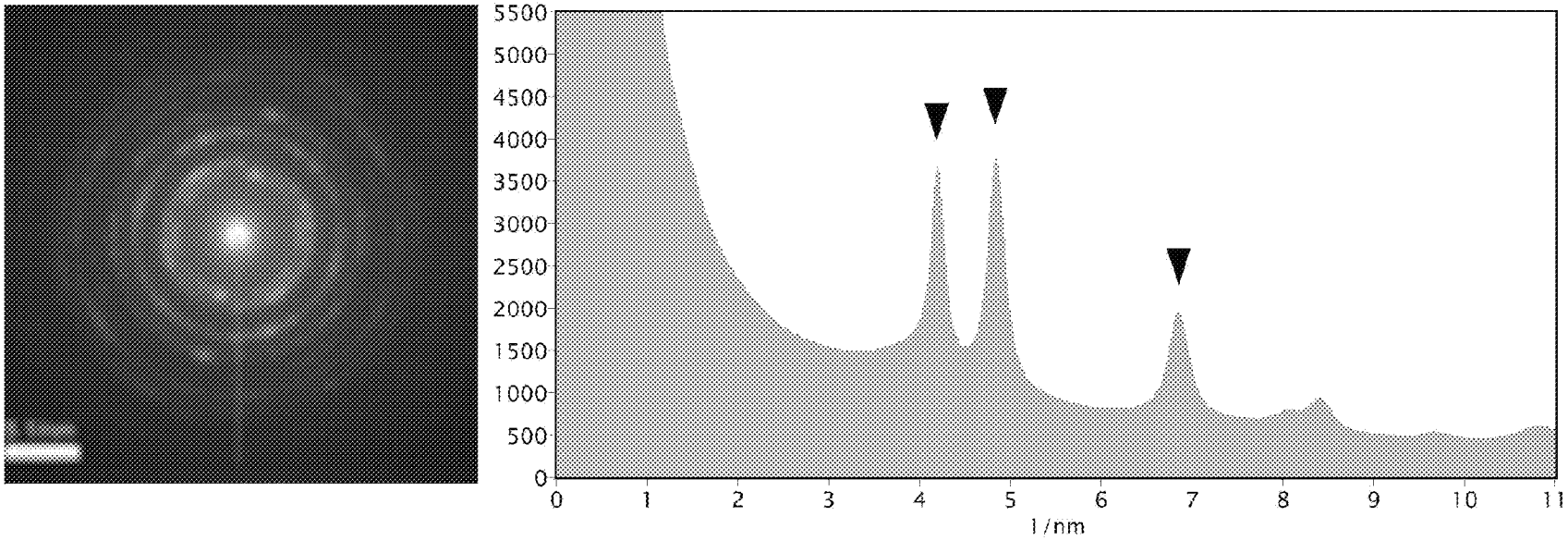
FIG. 2 is an example showing a selected area diffraction pattern of a sample No. 2 and an intensity profile thereof.
Figure 3:
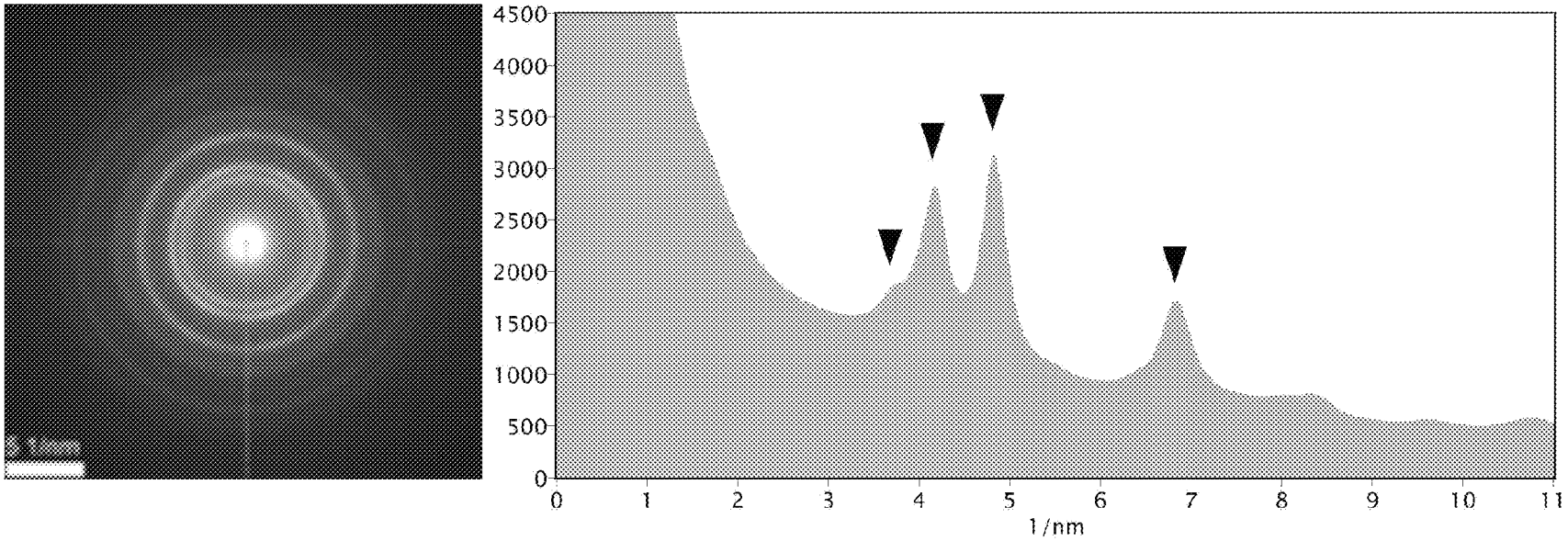
FIG. 3 is an example showing a selected area diffraction pattern of a sample No. 6 and an intensity profile thereof.

FIG. 1 shows an intensity profile of the selected area diffraction pattern of the sample No. 1. FIG. 2 shows an intensity profile of the selected area diffraction pattern of the sample No. 2. FIG. 3 shows an intensity profile of the selected area diffraction pattern of the sample No. 6.

From the intensity profile, it was confirmed that a large amount of AlN having the hcp structure is contained in the sample No. 6. For the sample No. 6, it is presumed that, since the amount of nitrogen is small, the nitride was not sufficiently formed at the micro level and the amount of AlN having the hcp structure was increased. Since the amount of the brittle AlN having the hcp structure was increased, the hardness and the elastic modulus of the sample No. 6 were low. In addition, it is presumed that, since a large amount of AlN having the hcp structure was contained, the structure becomes finer and the content ratio of Ar was also high.

On the other hand, for the samples No. 1 and 2, the content ratio of nitrogen was high and the micro-level nitride was sufficiently formed, and therefore, a peak of AlN having the hcp structure was not obtained in the intensity profile as the sample No. 6. For the sample No. 2, in the intensity profile of the selected area diffraction pattern, a peak of AlN having the hcp structure such as the sample No. 6 bras not obtained, but a slight amount of AlN having the hcp structure was obtained in the selected area diffraction pattern. On the other hand, for the sample No. 1, AlN having the hcp structure was not obtained in the selected area diffraction pattern. Therefore, for the sample No. 1, it is presumed that the hardness and the elastic modulus were higher than the sample No. 2.

EXAMPLE 2

In Example 2, a cutting evaluation was performed on a coated cutting tool provided with the multilayer coating film evaluated in Example 1. The process up to the bombardment treatment was the same as in Example 1.

In Present Example 1, after the bombardment treatment, while maintaining the temperature in the furnace at 430° C., Ar gas was introduced into the furnace of the sputtering apparatus in an amount of 400 sccm, and then $N_2$ gas was introduced in an amount of 490 sccm to set the pressure in the furnace as 0.72 Pa. Next, a −50 V DC bias voltage was applied to the tool, a maximum power density of 0.8 kW/cm 2 was additionally applied to the AlCr-based alloy target, the discharge time per power cycle was set as 0.8 milliseconds, time, for which the powers were applied to the AlCr-based alloy targets at the same time, was set as 10 microseconds, and a base layer having a film thickness of approximately 0.6 μm was coated.

Next, while maintaining the temperature in the furnace at 430° C., Ar gas was introduced into the furnace of the sputtering apparatus in an amount of 400 sccm, and then $N_2$ gas was introduced in an amount of 470 sccm to set the pressure in the furnace as Pa. Next, a −50 V DC bias voltage was applied to the tool, a maximum power density of 0.6 kW/cm 2 was applied to the AlCr-based alloy target, the discharge time per power cycle was set as 0.8 microseconds, and time, for which the powers were applied to the AlCr-based alloy targets at the same time, was set as 10 microseconds. In addition, a maximum power density of 1.5 kW/cm 2 was applied to the TiSi-based alloy target, the discharge time per cycle of power was 3.6 milliseconds, and the time, for which the powers were applied to the TiSi-based alloy targets at the same time, was set as 10 microseconds. Then, by continuously applying power to each alloy target, a multilayer coating film having an individual film thickness of approximately 4 nm and a total film thickness of approximately 0.1 μm was coated.

Next, while maintaining the temperature in the furnace at 430° C., Ar gas was introduced into the furnace of the sputtering apparatus in an amount of 400 sccm, and then $N_2$ gas was introduced in an amount of 200 sccm to set the pressure in the furnace as 0.54 Pa. A −50 V DC bias voltage was applied to the tool, a maximum power density of 1.5 $kW/cm^2$ was applied to the TiSi-based alloy target, the discharge time per power cycle was set as 3.6 microseconds, time, for which the applied power is applied to the TiSi-based alloy target at the same time, was set as 10 microseconds, and an upper layer having a film thickness of approximately 0.4 μm was coated.

Present Example 2 was set to be the same as Present Example 1, except that the introduction flow rate of the $N_2$ gas was set as 420 sccm and the pressure in the furnace was set as 0.62 Pa when coating the multilayer coating film.

Present Example 3 was set to be the same as the sample No. 1, except that the introduction flow rate of the $N_2$ gas was set as 520 sccm and the pressure in the furnace was set as 0.78 Pa when coating the multilayer coating film.

Present Example 4 was set to be the same as the sample No. 1, except that the introduction flow rate of the $N_2$ gas was set as 560 sccm and the pressure in the furnace was set as 0.83 Pa when coating the multilayer coating film.

Present Example 5 was set to be the same as the sample No. 1, except that the introduction flow rate of the $N_2$ gas was set as 600 sccm and the pressure in the furnace was set as 0.88 Pa when coating the multilayer coating film.

Comparative Example 1 was set to be the same as Present Example 1, except that the introduction flow rate of the $N_2$ gas was set as 340 sccm and the pressure in the furnace was set as 0.57 Pa when coating the multilayer coating film.

Comparative Example 2 was set to be the same as the sample No. 1, except that the introduction flow rate of the $N_2$ gas was set as 400 sccm and the pressure in the furnace was set as 0.60 Pa when coating the multilayer coating film.

<<Cutting Conditions>>

A cutting test was performed on the manufactured coated cutting tools under the following cutting conditions. Table 2 shows a result of the cutting test. Details of the cutting conditions are as follows.

<Processing Conditions>

Cutting method: bottom cutting
Work material: STAVAX (52HRC)
Tool used: two-blade ball end mill (tool diameter of 0.8 mm and neck length of 5 mm)
Depth of cut: 0.04 mm in an axial direction, 0.04 mm in a radial direction
Cutting speed: 60 m/min
feed per tooth: 0.018 mm/tooth
Coolant: dry processing
Cutting distance: 50 m

TABLE 2

| | Cutting evaluation (VBMax (mm)) |
|---|---|
| Present Example 1 | 0.018 |
| Present Example 2 | 0.018 |
| Present Example 3 | 0.023 |
| Present Example 4 | 0.020 |
| Present Example 5 | 0.026 |
| Comparative Example 1 | 0.026 |
| Comparative Example 2 | 0.030 |

In Present Examples 1 to 4, a maximum wear width was small and tool wear tends to be stable, compared to Comparative Examples 1 and 2. It is presumed that, since the multilayer coating film was N-rich and Ar-less, tool damage was suppressed. In Present Example 5 and Comparative Example 1, the maximum wear width was the same, but a tool damage state was more stable in Present Example 5.

The invention claimed is:

1. A coated cutting tool comprising:

a substrate; and a hard coating film formed on the substrate, wherein the hard coating film is a sputtering film, and the hard coating film includes, a b layer which is disposed on the substrate and is formed of a nitride or a carbonitride, a c layer which is a multilayer coating film laminated on the b layer and in which a c1 layer of a nitride or a carbonitride containing Al and Cr and a c2 layer of a nitride or a carbonitride containing Ti and Si are alternately laminated with a film thickness of 50 nm or less, respectively, and a d layer which is disposed on the c layer and is a nitride or a carbonitride of TiSi, and the c layer contains 0.02 atomic % or more and 0.10 atomic % or less of Ar with respect to a total amount of a metal (including metalloid) element and a non-metal element, in a case where a total of the metal (including metalloid) element, nitrogen, oxygen, carbon, and the Ar is set as 100 atomic %, has an atomic ratio A of the nitrogen and an atomic ratio B of the metal (including metalloid) element in the hard coating film satisfying a relationship of $1.02<A/B$, and has a face-centered cubic lattice structure, a thickness of the b layer and a thickness of the d layer are each greater than the total thickness of the c layer, and the thickness of the b layer is two or more times and ten or less times a thickness of the c layer.

2. The coated cutting tool according to claim 1, the c1 layer contains 50 atomic % or more of Al and 80 atomic % or more of a total content ratio of Al and Cr with respect to a total amount of a metal (including metalloid) element, and the c2 layer contains 50 atomic % or more of Ti and 10 atomic % or more of Si with respect to a total amount of a metal (including metalloid) element.

3. The coated cutting tool according to claim 1, the c layer does not have a diffraction pattern of AlN having an hcp structure in a selected area diffraction pattern using a transmission electron microscope.

4. The coated cutting tool according to claim 2, the c layer does not have a diffraction pattern of AlN having an hcp structure in a selected area diffraction pattern using a transmission electron microscope.

5. The coated cutting tool according to claim 1, wherein the thickness of the d layer is two or more times and ten or less times a thickness of the c layer.

* * * * *